US008221139B2

(12) United States Patent
Qin et al.

(10) Patent No.: US 8,221,139 B2
(45) Date of Patent: Jul. 17, 2012

(54) ELECTRICAL CONNECTOR HAVING A GROUND CLIP

(75) Inventors: Jie Qin, Hummelstown, PA (US); Steven J. Millard, Mechanicsburg, PA (US); David W. Helster, Dauphin, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 30 days.

(21) Appl. No.: 12/880,411

(22) Filed: Sep. 13, 2010

(65) Prior Publication Data

US 2012/0064743 A1 Mar. 15, 2012

(51) Int. Cl.
*H01R 4/66* (2006.01)

(52) U.S. Cl. ..... 439/92

(58) Field of Classification Search ..... 439/92, 439/101, 98, 579, 571, 947, 79–83, 61, 108
See application file for complete search history.

(56) References Cited

U.S. PATENT DOCUMENTS 4,475,781 A * 10/1984 Asick et al. ..... 439/61
4,611,867 A * 9/1986 Ichimura et al. ..... 439/101
4,762,500 A * 8/1988 Dola et al. ..... 439/79
4,907,979 A * 3/1990 Feldman ..... 439/83
4,917,616 A 4/1990 Demler, Jr. et al.
5,114,355 A 5/1992 Kimmel et al.
5,183,405 A 2/1993 Elicker et al.
5,263,870 A 11/1993 Billman et al.
5,453,026 A * 9/1995 Ikegami ..... 439/579
6,036,506 A 3/2000 Korsunsky

FOREIGN PATENT DOCUMENTS

WO WO 2010/056935 A1 5/2010

* cited by examiner

*Primary Examiner* — Edwin A. Leon

(57) ABSTRACT

An electrical connector includes a housing having a front and a rear opposite the housing with a rear wall at the rear. The housing has a slot open through the front that receives a mating connector therein. The housing has contact openings through the rear wall and a ground clip channel in the rear wall open at the rear. Signal contacts are held in the housing and arranged in pairs. The signal contacts are received in corresponding contact openings and are arranged within the slot to mate with the mating connector. Ground contacts are held in the housing and are arranged between corresponding signal contacts. The ground contacts are received in corresponding contact openings and are arranged within the slot to mate with the mating connector. A ground clip is loaded into the ground clip channel. The ground clip engages the ground contacts to create a ground circuit between the ground contacts engaged by the ground clip.

20 Claims, 3 Drawing Sheets

ELECTRICAL CONNECTOR HAVING A GROUND CLIP

BACKGROUND OF THE INVENTION

The subject matter herein relates generally to electrical connectors, and more particularly, to electrical connectors having ground clips.

In computer and other applications, it is commonly necessary to form a plurality of electrical connections between two printed circuit boards. These connections can be achieved through an interface between an edge of one printed circuit board and an electrical connector mounted on the other printed circuit board. Each application requires a certain orientation of the boards relative to each other. For example, the application may require that the boards be positioned perpendicular to each other. Other applications may require the boards to be positioned parallel to each other.

One way to achieve a parallel interface is to mount a right angle electrical connector on a printed circuit board which receives the edge of the other board. The right angle electrical connectors typically include a housing with contacts arranged in rows to engage a printed circuit board. The housing supports the contacts in a right angle orientation. The contacts typically comprise signal contacts arranged in pairs isolated from other pans of signal contacts by ground contacts in order to minimize crosstalk between the pairs. However, known electrical connectors are not without disadvantages. For instance, while the ground contacts do isolate signal pairs, the length of the ground contacts between the interfaces between the two circuit boards leads to resonances due to a standing wave created at ends of the ground contacts. The resonance noise can couple to signal pairs to degrade the signal performance.

A need remains for an electrical connector that provides signal pair isolation and that removes resonances that degrade signal performance.

BRIEF DESCRIPTION OF THE INVENTION in one embodiment, an electrical connector is provided that includes a housing having a front and a rear opposite the housing with a rear wall at the rear. The housing, has a slot open through the front that receives a mating connector therein. The housing has contact openings through the rear wall and a ground clip channel in the rear wall open at the rear. Signal contacts are held in the housing and arranged in pairs. The signal contacts are received in corresponding contact openings and are arranged within the slot to mate with the mating connector. Ground contacts are held in the housing and are arranged between corresponding signal contacts. The ground contacts are received in corresponding contact openings and are arranged within the slot to mate with the mating connector. A ground clip is loaded into the ground clip channel. The ground clip engages the ground contacts to create a ground circuit between the ground contacts engaged by the ground clip.

In another embodiment, an electrical connector is provided including a housing having a front and a rear opposite the front with a rear wall at the rear. The housing has a slot open through the front that, receives a mating connector therein. The housing has contact openings through the rear wall and ground clip channels in the rear wall that are open at the rear. Signal contacts are held in the housing and arranged in pairs. The signal contacts are received in corresponding contact openings and are arranged within the slot to mate with the mating connector. Ground contacts are held in the housing and are received in corresponding contact openings. The ground contacts are arranged within the slot to mate with the mating connector. At least one ground contact is arranged between each pair of signal contacts. Ground clips are loaded into corresponding ground clip channels. The ground clips are separate and distinct from one another and span across a corresponding pair of signal contacts and engage the ground contacts positioned on the opposite sides of the pair of signal contacts to create a ground circuit between the ground contacts engaged by the ground clip.

In a further embodiment, an electrical connector is provided that includes a housing having a base and a top opposite the base. The base is configured to be mounted to a circuit board. The housing has a front and a rear opposite the front with a rear wall at the rear. The housing has a slot open through the front that is configured to receive a card module therein and is configured to hold the card module parallel to the circuit board. The housing has contact openings through the rear wall and a ground clip channel in the rear wall open at the rear. Signal contacts are held in the housing. The signal contacts have a mating arm, a mounting arm and an intermediate portion therebetween. The mating arm extends into the slot and is configured to mate to the card module. The mounting arm is configured to be mounted to the circuit board. The signal contacts are arranged in pairs and are received in corresponding contact openings. Ground contacts are held in the housing between the pairs of signal contacts. The ground contacts have a mating arm, a mounting arm and an intermediate portion therebetween. The mating arm extends into the slot and is configured to mate to the card module. The mounting arm is configured to be mounted to the circuit board. The ground contacts are received in corresponding contact openings. A ground clip is loaded into the ground clip channel. The ground clip engages the intermediate portions of the ground contacts to create a ground circuit between the ground contacts engaged by the ground clip.

DETAILED DESCRIPTION OF-THE INVENTION

Figure 1:
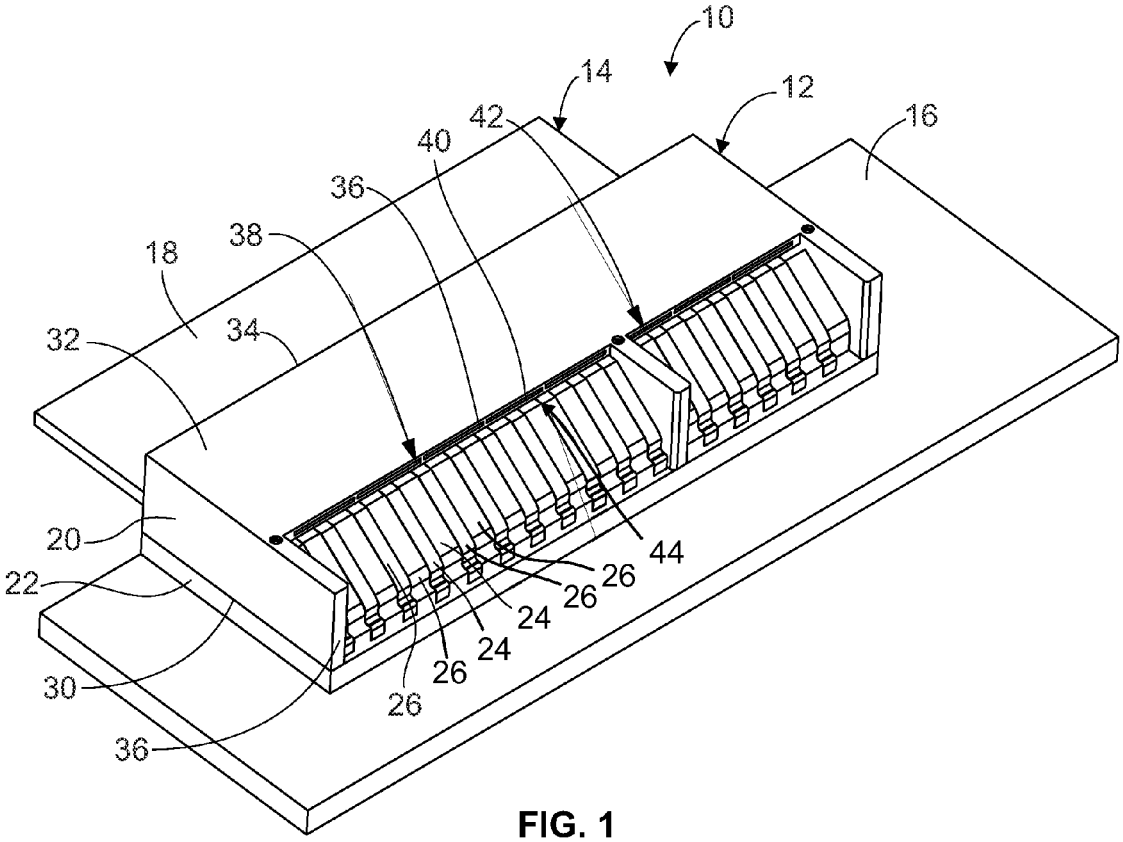
FIG. 1 illustrates a portion of an electronic device having an electrical connector formed in accordance with an exemplary embodiment.

FIG. 1 illustrates a portion of an electronic device 10 that includes an electrical connector 12 formed in accordance with an exemplary embodiment. A mating connector 14 is mated to the electrical connector 12. The electronic device 10 includes a circuit board 16, and the electrical connector 12 is mounted to the circuit board 16. The electrical connector 12 is used to interconnect the connector 14 and the circuit board 16.

In an exemplary embodiment, the electronic device 10 constitutes a computer, however the electronic device 10 may be another type of device such as a server, a consumer electronic device, an industrial electronic device, and the like. The circuit board 16 is held within the electronic device 10, such as within a housing (not shown) of the electronic device 10. The electrical connector 12 may be mounted internally, such as within the housing, or alternatively, may be mounted externally, such as outside the housing. Optionally, the electrical connector 12 may be mounted internally, with a mating face of the electrical connector 12 aligned with an opening or port in the housing to allow access to the electrical connector 12 from outside the electronic device 10. The mating connector 14 may then be mated with the electrical connector 12 from outside the electronic device 10. Alternatively, both the electrical connector 12 and mating connector 14 may be housed within the housing of the electronic device 10.

In an exemplary embodiment, the electrical connector 12 constitutes a right angle card edge connector. The mating connector 14 constitutes a card module configured to be plugged into the electrical connector 12. For example, the mating connector 14 may include a card module circuit board 18 having a plurality of pads arranged along an edge of the card module circuit board 18. The edge of the card module circuit board 18 is plugged into the electrical connector 12. The electrical connector 12 defines a right angle connector, wherein the mating connector 14 is mated along a direction that is parallel to the circuit board 16. The card module circuit board 18 is held within the electrical connector 12 such that the card module circuit board 18 is held parallel to the circuit board 16.

While the electrical connector 12 is illustrated and described as being a right angle electrical connector, it is realized that the electrical connector 12 may have other configurations in alternative embodiments. For example, the electrical connector 12 may be a vertical connector that receives the mating connector 14 in a perpendicular orientation with respect to the circuit beard 16. The electrical connector 12 may constitute another type of connector other than a card edge connector. For example, the electrical connector 12 may be mated with a different type of mating connector, such as a mating connector that is mounted to another circuit board, such as a daughter card. The mating connector 14 may thus include a housing holding a plurality of individual contacts that are terminated to the other circuit board and that are configured to be mated to the electrical connector 12. The subject matter herein is not intended to be limited a right angle card edge connector.

The electrical connector 12 includes a housing 20 and organizer 22 positioned between the housing 20 and the circuit board 16. The electrical connector 12 also includes signal contacts 24 and ground contacts 26 held within the housing 20. The signal and ground contacts 24, 26 are also held by the organizer 22 for mounting to the circuit board 16. Optionally, the electrical connector 12 may be provided without the organizer 22, where the housing 20 and signal and ground contacts 24, 26 are directly mated to the circuit board 16.

The housing 20 has a base 30 and a top 32 opposite the base 30. The base 30 is configured to be mounted to the organizer 22 and/or the circuit board 16. The housing 20 has a front 34 and a rear 36 opposite the front 34. A rear wall 38 defines the rear 36. The signal and ground contacts 24, 26 extend through the rear wall 38 and extend from the rear 36 down to the organizer 22. The mating connector 14 is coupled to the electrical connector 12 at the front 34. The mating connector 14 extends from the front 34 when mated thereto.

In an exemplary embodiment, the electrical connector 12 includes a plurality of ground clips 40 held in the housing 20. The ground clips 40 are held in the rear wall 38. Optionally, the ground clips 40 may extend from the rear 36 of the rear wall 38. The ground clips 40 engage corresponding ground contacts 26 to create a ground circuit between the ground contacts 26. Any number ground clips 40 may be provided. Each ground clip 40 may engage any number of the ground contacts 26. In the illustrated embodiment, each ground clip 40 engages two ground contacts 26. The ground clip 40 electrically commons the ground contacts 26 engaged by the ground clip 40. The ground clip 40 may be used to electrically common other types of contacts in alternative embodiments, such as power contacts.

The housing 20 includes a plurality of ground clip channels 42 formed in a rear wall 38. The ground clip channels 42 are open at the rear 36. The ground clips 40 are loaded into the ground clip channels 42 through the rear 36. Optionally, at least a portion of the ground clips 40 may extend from the ground clip channels 42. The housing 20 includes a plurality of contact openings 44 extending through the rear wall 38. The contact openings 44 are open at the rear 36. The signal and ground contacts 24, 26 extend through the contact openings 44.

Figure 2:
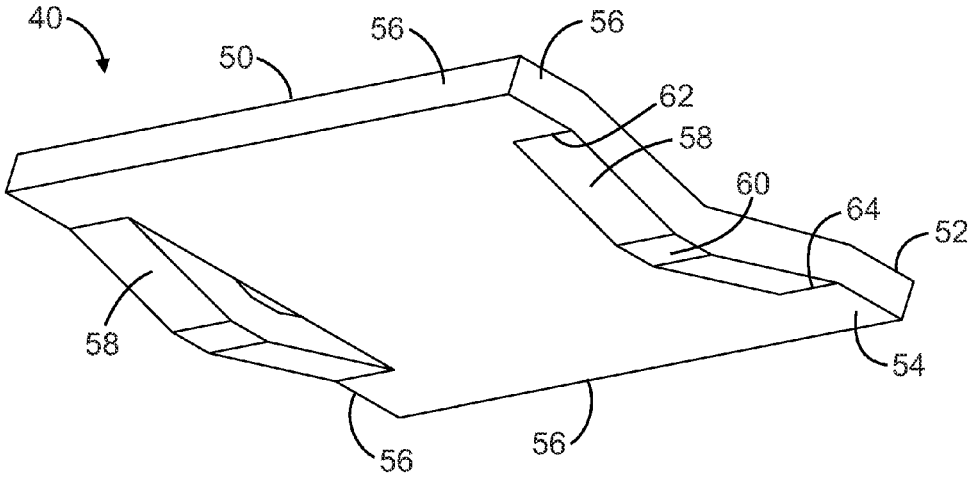
FIG. 2 is a bottom perspective view of a ground clip of the electrical connector shown in FIG. 1.

FIG. 2 is a bottom perspective view of one of the ground clips 40. The ground clip 40 includes a planar base 50 extending between opposite first and second sides 52, 54. The ground clip 40 has a generally rectangular shape extending between four edges 56. The ground clip 40 may have a different shape in alternative embodiments.

The ground clip 40 includes a pair of tabs 58 extending from the second side 54. Optionally, more than two tabs 58 may be provided in alternative embodiments, such as when the ground clip 40 is configured to engage more than two ground contacts 26 (shown in FIG. 1). The number of tabs 58 may correspond with the number of ground contacts 26 engaged by the ground clip 40. Optionally, the ground clip 40 may include more tabs 58 than the number of ground contacts 26 that are engaged by the ground clip 40. For example, the ground clip 40 may include multiple tabs 58 that engage each ground contact 26.

In an exemplary embodiment, the ground clip 40 is stamped and formed, where the tabs 58 are drawn out of plane from the base 50 such that an apex 60 of the tab 58 is positioned below the second side 54. Opposite ends 62, 64 of the tabs 58 are both connected to (e.g., integral with) the base 50. Alternatively, one end of each tab 58 may be sheared or cut from the base 50 and bent out of plane such that the end is positioned below the second side 54. In such embodiment, the tabs 58 are cantilevered from the base 50.

Figure 3:
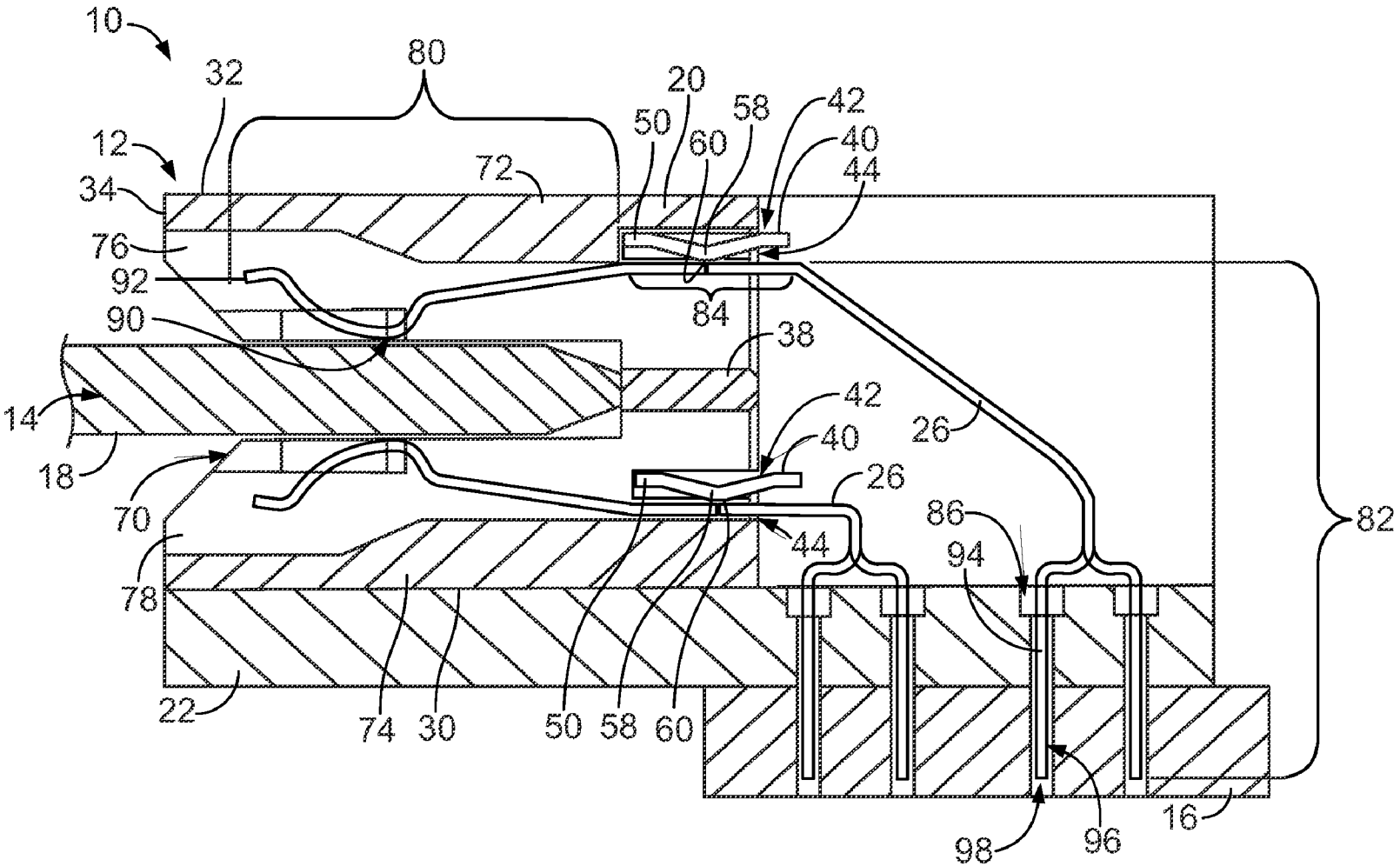
FIG. 3 is a cross-sectional view of the electrical connector mounted to a circuit board with a portion of a mating connector coupled to the electrical connector.

FIG. 3 is a cross-sectional view of the electrical connector 12 mounted to the circuit board 16. The cross-section is taken through a pair of the ground contacts 26. FIG. 3 illustrates the ground clips 40 loaded into the ground clip channels 42 such that the ground clips 40, engage the ground contacts 26.

In the illustrated embodiment, the ground contacts 26 are loaded into the housing 20 in two rows, namely an upper row and a lower row. Different ground clips 40 engage the ground contacts 26 in each row. The ground clips 40 are loaded into the ground clip channels 42 such that the bases 50 are generally parallel to the circuit board 16. The tabs 58 extend from the bases 50 toward the corresponding ground contact 26. The apex 60 of each tab 58 engages the corresponding ground contact 26 to make an electrical connection therebetween. The ground clips 40 may be held in the ground clip channels 42 by an interference fit. Alternatively, the ground clips 40 may be secured in place with respect to the ground contacts 26 by alternative means. For example the ground clips 40 may be secured directly to the ground contacts 26, such as by soldering, fastening or otherwise securing the ground clips 40 to the ground contacts 26. When directly secured to the ground contacts 26, the ground clips 40 may not need to be held within the housing 20.

The housing 20 includes a slot 70 open through the front 34 that receives the mating connector 14 therein. The slot 70 is oriented generally parallel to the circuit board 16 such that the mating connector 14 is held in slot 70 generally parallel to the circuit board 16. Alternatively, the slot 70 may be oriented generally perpendicular with respect to the circuit board 16, or at another non-parallel angle with respect to the circuit board 16 in alternative embodiments. The mating connector 14 is loaded into the slot 70 until the edge of the card module circuit board 18 bottoms out against the rear wall 38.

The slot 70 is positioned between an upper wall 72 and a lower wall 74 of the housing 20. The upper wall 72 extends forward from the rear wall 38 and is positioned between the slot 70 and the top 32 of the housing 20. The lower wall 74 extends forward from the rear all 38 and is positioned between the slot 70 and the base 30. Spacer walls 76, 78 extend inward into the slot 70 from the upper wall 72 and the lower wall 74, respectively. The ground contacts 26 and signal contacts 24 (shown in FIG. 1) are received in the spaces between the corresponding spacer walls 76, 78.

The ground contact 26 includes a mating arm 80, a mounting arm 82 and an intermediate portion 84 therebetween. The mating arm 80 extends into the slot 70 and is configured to mate to the card module circuit board 18 of the connector 14. For example, the mating arm 80 may engage a pad on a corresponding side or surface of the card module circuit board 18. Alternatively, when the mating connector 14 does not include a card module circuit board, but rather includes individual contacts held within a housing, the mating arm 80 is configured to engage the corresponding contact of the mating connector 14. The mating arm 80 includes a mating interface 90 proximate to a distal end 92 of the mating arm 80. The mating interface 90 is the portion of the mating arm 80 that is configured to engage the card module circuit board 18. Optionally, the mating interface 90 may be convex in shape to allow mating engagement with the card module circuit board 18. Optionally, the mating arm 80 may be angled towards a center of the slot 70 from the contact opening 44. In an exemplary embodiment, when the card module circuit board 18 is loaded into the slot 70, the mating atm 80 may be deflected outward. Such deflection imparts a normal force on the card module circuit board 18. When deflected, the mating arm 80 is biased against the card module circuit board 18.

The mounting arm 82 extends from the rear wall 38 and is configured to be mounted to the circuit board 16. In an exemplary embodiment, the mounting arm 82 is received in an opening 86 in the organizer 22 and is held by the organizer 22 for mounting to the circuit board 16. Optionally, the mounting arm 82 may extend at an angle with respect to the mating arm 80. For example, the mounting arm 82 may extend at approximately a 45° angle from the elevated position at which the ground contact 26 extends from the rear wall 38 downward towards the organizer 22 and the circuit board 16. Alternatively, the mounting arm 82 may extend generally perpendicular with respect to the mating arm 80 from the elevated position at which the ground contact 26 extends from the housing 20 downward toward to the organizer 22 and circuit board 16.

The mounting arm 82 includes a pin 94 at an end thereof. The pin 94 defines a mounting interface 96 for mounting to the circuit board 16. In an exemplary embodiment, the circuit board 16 includes vias 98 extending therethrough. The pins 94 are received in the vias 98 and electrically connected to the circuit board 16 by the interface between the pin 94 and the via 98. Optionally, the pins 94 may be connected to the vias 98 by soldering the pins 94 in the vias 98. Alternatively, the pins 94 may constitute compliant pins, such as eye-of-the-needle pins that are electrically connected to plating within the vias 98. In other alternative embodiments, the pins 94 may be surface mounted to the circuit board 16, such as soldering the pins 94 to pads on the circuit board 16. In such embodiment, the pins 94 are bent parallel to the surface of the circuit board 16 and soldered to the corresponding pads. Other mounting means may be utilized in alternative embodiments to electrically connect the ground contacts 26 to the circuit board 16.

The signal contacts 24 (shown in FIG. 1) may be similar to the ground contacts 26. For example, the signal contacts 24 may include a mating arm, a mounting arm and an intermediate portion therebetween. The signal contacts 24 may be electrically connected to the mating connector 14 in a similar manner as the ground contacts 26. The signal contacts 24 may be electrically connected to the circuit board 16 in a similar manner as the ground contacts 26. In an exemplary embodiment, the signal contacts 24 are not electrically connected to the ground 40. Rather, the ground clip 40 is spaced apart from the signal contacts 24. An insulator, such as the housing 20 or air may be provided between the ground clip 40 and the signal contacts 24.

The intermediate portion 84 is provided between the mating arm 80 and mounting arm 82. The intermediate portion 84 is the portion of the ground contact 26 that extends through the rear wall 38. The intermediate portion 84 is approximately centered between the opposite ends of the ground contact 26. For example, the mating arm 80 and mounting arm 82 may have similar lengths. The ground clip 40 is positioned within the housing 20 such that the tabs 58 engage the intermediate portion 84. The intermediate portion 84 is generally defined as the portion of the ground contact 26 engaged by the ground clip 40.

A ground path is defined between the mounting interface 96 and the mating interface 90. Such ground path has a certain length, defined as the distance along the ground contact 26 between the mounting interface 96 and mating interface 90. Such ground path length corresponds with a certain resonance frequency. A longer ground path length corresponds with a relatively lower resonance frequency, while a shorter ground path length corresponds with a relatively higher resonance frequency.

When the ground clip 40 is loaded into the housing 20 and makes electrical contact with the ground contact 26, an electrical circuit is created through the ground clip 40 and through the ground contacts 26 engaged by the ground clip 40. A second ground path is defined along the ground contact 26 between the mounting interface 96 and the point of the intermediate portion 84 engaged by the tab 58 of the ground clip 40. This second ground pathway is shorter than the first ground pathway between the mounting interface 96 and the mating interface 90. The length of the second ground path corresponds with a predetermined resonance frequency that is higher than the resonance frequency of the ground contact 26 without the ground clip 40. A third ground path is defined along the ground contact 26 between the mating interface 90 and the point of the intermediate portion 84 engaged the of the ground clip 40. This third ground pathway is shorter than the first ground pathway between the mounting interface 96 and the mating interface 90. The length of the second ground path corresponds with a predetermined resonance frequency that is higher than the resonance frequency of the ground contact 26 without the ground clip 40. Optionally, the second and third ground paths may have similar path lengths.

In an exemplary embodiment, it may desirable to provide an electrical connector 12 that has a resonance frequency at a particular frequency that is within a particular frequency range, or is above or below a predetermined frequency value. For example, it may be desirable to have an electrical connector 12 that has a resonance frequency above 7 GHz. Any frequency value above 7 GHz may be acceptable. Optionally, it may be desirable to have an electrical connector 12 that has a resonance frequency above 20 GHz. Any frequency value above 20 GHz may be acceptable. Optionally, it may desirable to provide an electrical connector 12 that has a resonance frequency of approximately 40 GHz. Other frequency ranges may be of interest, and the electrical connector 12 may be designed to meet such frequencies. It is possible to control the value of the resonance frequency by controlling the position of the interface between the ground clip 40 and the ground contact 26. For example, by making the ground path length longer, the resonance frequency might be decreased, and conversely, by making the ground pathway shorter, the resonance frequency might be increased. The position of the ground clip 40 with respect to the ground contact 26 may be controlled by positioning the ground clip channel 42 at a selected location with respect to the ground contact 26 and/or controlling a length of the ground contact 26 between the mounting interface 92 and the intermediate portion 84 and/or between the mating interface 90 and the intermediate portion 84.

Figure 4:
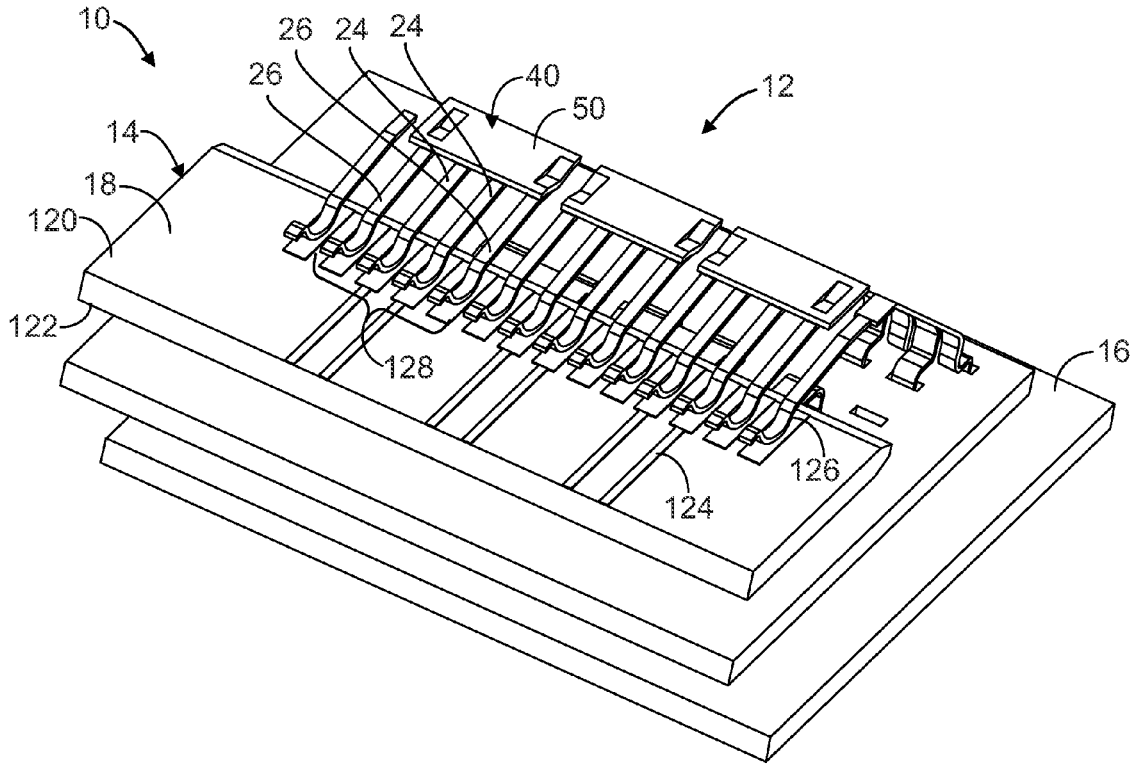
FIG. 4 illustrates a portion of the electronic device showing the electrical connector and the mating connector, with a housing of the electrical connector removed for clarity.

FIG. 4 illustrates a portion of the electronic device 10 showing the electrical connector 12 and mating connector 14, with the housing 20 removed for clarity. FIG. 4 shows the card module circuit board 18 positioned between the upper and lower rows of signal and ground contacts 24, 26.

The card module circuit board 18 has a first side 120 and a second side 122. A plurality of signal traces 124 are arranged along the first and second sides 120, 122. The card module circuit board 18 includes a plurality of ground pads 126 arranged along the first and second sides 120, 122. Optionally, each of the ground pads 126 may be electrically commoned with a ground layer of the card module circuit board 18. The ground contacts 26 are configured to engage corresponding ground pads 126 when the card module circuit board 18 is loaded into the housing 20. The signal contacts 24 are configured to engage corresponding signal traces 124 when the card module circuit board 18 is loaded into the housing 20

The signal contacts 24 and ground contacts 26 may be arranged in any pattern depending on the particular application. In the illustrated embodiment, the signal contacts 24 and ground contacts 26 are arranged in a ground-signal-signal-ground pattern, which defines a contact set 128. The pattern of signal traces 124 and ground pads 126 correspond with the pattern of signal and ground contacts 24, 26.

In the illustrated embodiment, the signal contacts 24 are arranged in pairs configured to carry differential signals. The pairs of signal contacts 24 are separated by at least one ground contact 26. In the illustrated embodiment, two ground contacts 26 are provided between adjacent pairs of signal contacts 24. However, any number of ground contacts 26 may be provided between the adjacent pairs of signal contacts 24 in alternative embodiments. In other alternative embodiments, rather than carrying differential signals, the signal contacts 24 may be configured to carry single ended signals. In such embodiments, each signal contact 24 may be separated from adjacent signal contacts by one or more ground contacts 26. For example, the signal and ground contacts 24, 26 may be arranged in ground-signal-ground-signal-ground pattern. Such alternating sequence of signal and ground contacts 24, 26 provides ground contacts 26 between signal contacts 24, which may reduce crosstalk between the signal contacts and improve electrical performance of the electrical connector 12.

The ground clips 40 are coupled to corresponding ground contacts 26. In the illustrated embodiment, a separate ground clip 40 is provided for each contact set 128. The ground clip 40 engages both ground contacts 26 within the contact set 128. The base 50 spans across the signal contact 24. The ground clip 40 is electrically isolated from the signal contacts 24. For example, the base 50 may be elevated above the signal contacts 24 such that the base 50 does not engage the signal contacts 24. Optionally, an insulator, such as the dielectric material of the housing 20, may be provided between the base 50 and the signal contacts 24. In an alternative embodiment, rather than having individual ground clips 40 for each contact set 128, the ground clips 40 may be elongated such that the ground clip 40 is configured to engage ground contacts 26 of more than one contact set 128.

When assembled, the ground clips 40 engage the wound contacts 26 in the mid region of the ground contacts 26, creating aground circuit between the ground contacts 26 within the contact set 128. By connecting the ground contacts 26 within the contact set 128, the effective ground path lengths of the ground contacts 26 are shortened, which may shrink the standing wavelength of the ground contacts 26. The resonance frequent of the ground contacts 26 is effectively increased, and depending on the ground path length, may increase the resonance frequency to a level outside of the frequency band concerned. For example, the resonance frequency may be increased to a level above 20 GHz, which is a level at which the resonance frequency does not have a detrimental effect on the signal performance of the pair of signal contacts 24.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientation's of the various components, and the number and positions of the various, components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as, labels, and are not intended to impose numerical requirements on their objects. Further, the limitations of the 'following' claims are not written in means—plus-function format and not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a front and a rear opposite the front, the housing having a rear wall at the rear, the housing having a slot open through the front configured to receive a mating connector therein, the housing having contact openings through the rear wall;

signal contacts held in the housing, the signal contacts arranged in pairs, the signal contacts received in corresponding contact openings, the signal contacts being arranged within the slot to mate with the mating connector;

ground contacts held in the housing, the ground contacts arranged between corresponding signal contacts, the ground contacts received in corresponding contact openings, the ground contacts being arranged within the slot to mate with the mating connector; and a ground clip engaging the ground contacts to create a ground circuit between the ground contacts engaged by the ground clip.

2. The electrical connector of claim 1, wherein the ground clip includes a planar base having opposite sides, the ground clip having tabs extending from one of the sides, the tabs engaging the ground contacts.

3. The electrical connector of claim 1, wherein the ground clip includes a pair of tabs extending therefrom, the tabs engaging the corresponding ground contacts.

4. The electrical connector of claim 1, wherein each ground contact includes a mating interface and a mounting interface, the mating interface being configured to engage the mating connector, the mounting interface being configured to engage a circuit board, the ground clip engaging the corresponding ground contacts between the mating and mounting interfaces to shorten an effective ground path length of the ground circuit.

5. The electrical connector of claim 1, wherein each ground contact includes a mating interface and mounting interface, the mating interface being configured to engage the mating connector, the mounting interface being configured to be mounted to a circuit board, the ground clip engaging the corresponding ground contacts at a predetermined location between the mating interface and the mounting interface to increase a resonance frequency of the electrical connector to above 10 GHz.

6. The electrical connector of claim 1, wherein the housing includes a plurality of ground clip channels, the electrical connector comprising a plurality of the ground clips separate and distinct from one another, each ground clip spanning across a corresponding pair of signal contacts and engaging the corresponding ground contacts located on opposite sides of the corresponding pair of signal contacts.

7. The electrical connector of claim 1, wherein the housing has a ground clip channel in the rear wall open at the rear, the ground clip being held within the ground clip channel in the rear wall of the housing.

8. The electrical connector of claim 1, wherein the ground clip engages the ground contacts at a position within 10% of a midpoint of the ground contact.

9. The electrical connector of claim 1, wherein the housing defines a right angle housing, the housing being configured to be coupled to a circuit board such that the slot receives the mating connector in a direction parallel to the circuit board.

10. The electrical connector of claim 1, wherein the signal contacts and ground contacts are grouped into contact sets having a ground-signal-signal-ground pattern, the ground clip engaging only the ground contacts within the corresponding contact set.

11. An electrical connector comprising:

a housing having a front and a rear opposite the front, the housing having a rear wall at the rear, the housing having a slot open through the front configured to receive a mating connector therein, the housing having contact openings through the rear wall, the housing having ground clip channels in the rear wall open at the rear;

signal contacts held in the housing, the signal contacts arranged in pairs, the signal contacts received in corresponding contact openings, the signal contacts being arranged within the slot to mate with the mating connector;

ground contacts held in the housing, the ground contacts received in corresponding contact openings, the ground contacts being arranged within the slot to mate with the mating connector, at least one ground contact being arranged between each pair of signal contacts; and ground clips loaded into corresponding ground clip channels, the ground clips being separate and distinct from one another, the ground clips spanning across a corresponding pair of signal contacts and engaging the ground contacts positioned on the opposite sides of the pair of signal contacts to create a ground circuit between the ground contacts engaged by the ground clip.

12. The electrical connector of claim 11, wherein each ground clip includes a planar base having opposite sides, the ground clip having tabs extending from one of the sides, the tabs engaging the corresponding ground contacts.

13. The electrical connector of claim 11, wherein each ground contact includes a mating interface and a mounting interface, the mating interface being configured to engage the mating connector, the mounting interface being configured to engage a circuit board, the ground clip engaging the corresponding ground contacts between the mating and mounting interfaces to shorten an effective ground path length of the ground circuit.

14. The electrical connector of claim 11, wherein the ground clips are held within the rear wall.

15. The electrical connector of claim 11, wherein the signal contacts and ground contacts are grouped into contact sets having a ground-signal-signal-ground pattern, the ground clips engaging only the ground contacts within the corresponding contact set.

16. An electrical connector comprising:

a housing having a base and a top opposite the base, the base being configured to be mounted to a circuit board, the housing having a front and a rear opposite the front, the housing having a rear wall at the rear, the housing having a slot open through the front configured to receive a card module therein and configured to hold the card module parallel to the circuit board, the housing having contact openings through the rear wall;

signal contacts held in the housing, the signal contacts having a mating arm, a mounting arm and an intermediate portion therebetween, the mating arm extending into the slot and being configured to mate to the card module, the mounting aim being configured to be mounted to the circuit board, the signal contacts arranged in pairs, the signal contacts received in corresponding contact openings;

ground contacts held in the housing between the pairs of signal contacts, the ground contacts having a mating arm, a mounting aim and an intermediate portion therebetween, the mating arm extending into the slot and being configured to mate to the card module, the mounting arm being configured to be mounted to the circuit board, the ground contacts received in corresponding contact openings; and a ground clip engaging the intermediate portions of the ground contacts to create a ground circuit between the ground contacts engaged by the ground clip.

17. The electrical connector of claim 16, wherein the ground clip includes a planar base having opposite sides, the ground clip having tabs extending from one of the sides, the tabs engaging the ground contacts.

18. The electrical connector of claim 16, wherein the housing has a ground clip channel in the rear wall open at the rear, the ground clip being held within the ground clip channel in the rear wall of the housing.

19. The electrical connector of claim 16, wherein the ground clip engages the corresponding ground contacts between the mating and mounting interfaces to shorten an effective ground path length of the ground circuit.

20. The electrical connector of claim 16, wherein the signal contacts and ground contacts are grouped into contact sets having a ground-signal-signal-ground pattern, the ground clip engaging only the ground contacts within the corresponding contact set.

* * * * *